US005347900A

United States Patent [19]

Ceaser et al.

[11] Patent Number: 5,347,900

[45] Date of Patent: Sep. 20, 1994

[54] FOAM BLOCK BORE CUTTING APPARATUS

[76] Inventors: Philip N. Ceaser, P.O. Box 411, Scarborough, Me. 04070-0411; Norman G. Ceaser, P.O. Box 247, Scarborough, Me. 04070-0247

[21] Appl. No.: 15,593

[22] Filed: Feb. 10, 1993

[51] Int. Cl.[5] ..... B26D 7/10

[52] U.S. Cl. ..... 83/171; 83/425.3; 83/856

[58] Field of Search ..... 83/171, 651.1, 858, 83/425.2, 425.3, 435.1, 16, 856, 857

[56] References Cited

U.S. PATENT DOCUMENTS

| | | | |
|---|---|---|---|
| 2,611,434 | 9/1952 | Mugler | 83/171 |
| 3,396,616 | 8/1968 | Wright | 83/171 X |
| 4,271,737 | 6/1981 | Steenson et al. | 83/171 |
| 4,485,295 | 11/1984 | Kellermeyer | 83/171 X |
| 4,754,678 | 7/1988 | Nichols et al. | 83/171 X |
| 5,121,679 | 6/1992 | Mertz | 83/425.3 X |

FOREIGN PATENT DOCUMENTS

| | | | |
|---|---|---|---|
| 1324848 | 7/1987 | U.S.S.R. | 83/171 |

*Primary Examiner*—Eugenia Jones

*Attorney, Agent, or Firm*—William B. Ritchie

[57] ABSTRACT

A bore cutting apparatus for polystyrene blocks. Using a plurality of bore forming tubular members, each with its own resistive heating element, a foam block can be bored with a plurality of uniformly sized and shape openings, even openings having a square cross-sectional shape. The foam blocks can then be utilized in a building construction that enables walls to be quickly, inexpensively produced, having structural strengths greater than conventional wood framing methods. The apparatus can also be used for the packaging industry to produce large foam packing materials on a custom basis. The apparatus is fabricated from low cost, easily available materials and is light enough and sufficiently portable to be taken to the job site.

11 Claims, 8 Drawing Sheets

FOAM BLOCK BORE CUTTING APPARATUS

BACKGROUND OF THE INVENTION

1. Field of the Invention

The invention relates to an apparatus for construction of foam blocks having specific voids into which concrete and reinforcing rods can be placed to rapidly and inexpensively form building structures. Additionally, the apparatus can be utilized for creating large blocks for use in the packaging industry.

2. Description of the Related Art

The use of foam blocks in the packaging industry is well known. Molded polystyrene blocks are used as packing material for everything from large objects such as televisions, to the smallest such as ICs. The desirability of polystyrene blocks or other foam blocks having a plurality of cylindrical voids where wall structures can be quickly made by placing reinforcing rods within the voids and then pouring concrete into them is well known as well.

U.S. Pat. No. 4,532,745, issued to Kinard on Aug. 6, 1985, discloses an improved channel apparatus for use in foam block construction. Kinard specifies the use of rectangular blocks, preferably fabricated from expanded polystyrene beads which have the additional advantage of providing a high insulating value. Further, Kinard specifies cylindrical openings having predetermined spacing and diameter but does not disclose or suggested how the openings are to be made in the block.

U.S. Pat. No. 4,249,354, issued to Wynn on Feb. 10, 1981, discloses another method for fabricating an insulated wall panel using reinforced concrete. In this disclosure, the abutting ends of each block has a semi-cylindrical channel formed in its abutting end, lined with a sleeve when the blocks are connected together. It is not disclosed as to how these semi-cylindrical channels are to be fabricated except to suggest that it is done on sight.

Still another disclosure, U.S. Pat. No. 4,038,798, issued to Sachs on Aug. 2, 1977, specifies the use of polystyrene blocks with cylindrical channels lined with cardboard inserts. In this disclosure, each foam block is molded using the cardboard inserts thereby achieving the necessary voids to hold the poured concrete and rebar.

Other attempts have been utilized to produce cylindrical holes in foam blocks that can be used in construction. Drilling has been tried with limited success, since this technique produces ragged holes and a substantial environmental problem of loose polystyrene beads and dust. Again, all these techniques attempt to produce cylindrical channels only.

None of these disclosures provide a method of obtaining foam blocks with concrete/rebar channels that can be inexpensively and accurately formed in a variety of shapes and sizes on the job site using standard commercially available polystyrene rectangular blocks.

The difficulty in cutting polystyrene foam once a block has been formed is well known in the art. Likewise, using a heating element to melt foam is similarly well known.

U.S. Pat. No. 4,641,016 is a device for forming cylindrical tunnels in foam panels once in place in walls to accommodate electrical cables or conduits. This apparatus is designed to vaporize the foam material into which an appropriate tunnel is bored. A heated bit is advanced into the foam material and as it advances into the material it vaporizes the foam by sublimation, thus creating a tunnel in which the walls are hardened as a result of the vaporized material.

U.S. Pat. No. 3,396,616 discloses an electrically heated lance slidably held in a guide for use in perforating foam plastics, and forming long holes. This apparatus is an elongated heating configuration with a narrow elongated tapered point and a body portion of the desired hole size. The body is at a sufficient temperature to melt the foam material. The apparatus is applied to foam material by forcing the body section through the foam and melting the foam as the body section passes through.

U.S. Pat. No. 3,985,996, issued to Fischer on Oct. 12, 1976, discloses an apparatus for use in cutting arbitrary shapes in foam material. This apparatus features a loop of bendable, shape-retaining, electrically conductive resistive wire. A bore hole may be cut in foam material with this apparatus by rotating the wire element in a circular pattern. Different diameters are achieved by varying the size of the loop. However, this device does not disclose or suggest a method by which a channel could be fabricated within a foam block that has an internal wall that maintains its wall integrity throughout and has uniform bore cross section.

Nothing in the prior art provides for a method and apparatus for constructing a foam block having a plurality of predetermined bores with uniform bore cross sections of varying shapes and sizes and having a closed internal wall so that concrete poured therein cannot escape.

SUMMARY OF THE INVENTION

It is an object of the invention to provide an apparatus for simultaneously boring a plurality of bores in a foam block with each bore having uniform bore dimensions throughout the length of the bore.

It is an object of the invention to provide an apparatus for simultaneously boring a plurality of bores in a foam block where the bore cross-section can be different shapes such as square, rectangular, circular, polygonal and free form.

It is an object of the invention to provide an apparatus for simultaneously boring a plurality of bores in a foam block where the material removed to form the bore can be easily recycled.

It is an object of the invention to provide an apparatus for simultaneously boring a plurality of bores in a foam block.

It is an object of the invention to provide an apparatus for simultaneously boring a plurality of bores in a foam block so that the foam block can be efficiently utilized in the construction of a building.

It is an object of the invention to provide an apparatus for simultaneously boring a plurality of bores in a foam block so that the foam block can be efficiently utilized in the packaging industry.

It is an object of the invention to provide an apparatus for simultaneously boring a plurality of bores in a foam block such that the apparatus is low cost and can used at the construction site if desired.

It is an object of the invention to provide an apparatus for simultaneously boring a plurality of bores in foam blocks that are at least 4′ by 8′ by 8″ thick.

It is an object of the invention to provide an apparatus for simultaneously boring a plurality of bores in a foam block that can be filled with reinforced concrete without the addition of liners or other methods to retain the concrete until it is cured.

Finally, it is an object of the invention to provide an apparatus for simultaneously boring a plurality of bores in a foam block that can be inexpensively constructed using materials that can be readily obtained from standard electrical supply and metal supply firms.

The invention is a bore making apparatus for a foam block. A frame is provided. Attached to the frame are a plurality of tubular bore forming members, aligned in an array with each member spaced a pre-determined distance from an adjacent member and each member having a foam contact end. Attached to the foam contact end of each bore forming member are means for heating at a predetermined heat output, for forming a bore within said foam block corresponding to the cross-sectional shape and size of said tubular bore forming member. Foam supporting means for rigidly holding said foam block, slidably mounted within said frame is also provided. Means for sliding said foam supporting means into said array of bore forming members at a predetermined rate corresponding to said predetermined heat output, such that a plurality of bores of uniform thickness and cross-section are substantially simultaneously formed within said foam block with the cores of said bores being enclosed within said tubular bore forming members is also provided.

DETAILED DESCRIPTION OF THE INVENTION

Figure 1:
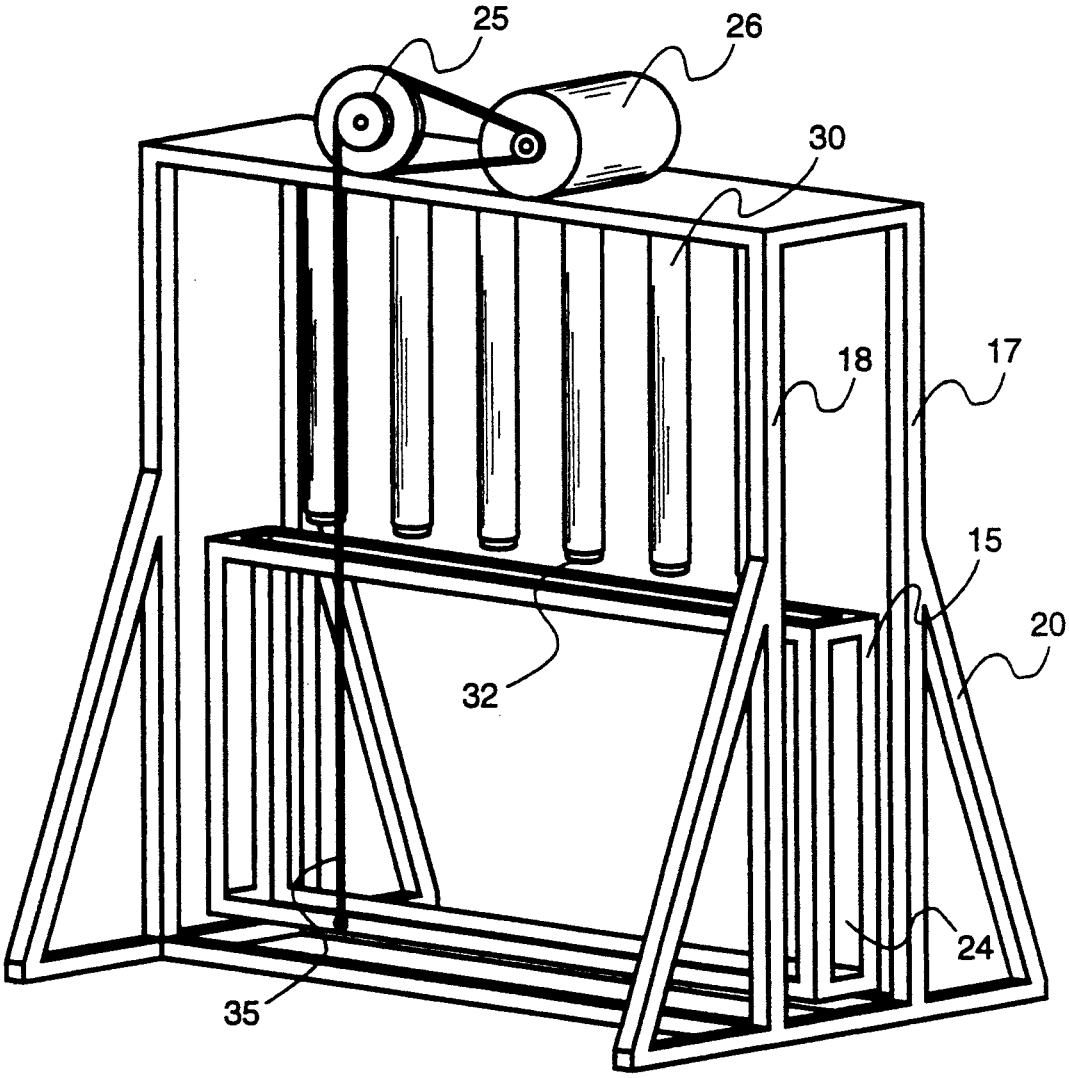
FIG. 1 is an isometric view of the apparatus in accordance with the invention.

FIG. 1 is an isometric view of the apparatus in accordance with the invention. The apparatus comprises three main assemblies: the frame, the bore forming assembly and the foam block support assembly. Frame 20, preferably fabricated from standard angle iron, provides the support to hold the other two assemblies in proper alignment relative to one another during the boring cutting process. The foam support assembly consists of foam block cage 15, cable 35, pulley 25 and motor 26. Cage 15 is also preferably made from angle iron positioned so that a foam block may be inserted via opening 24 and supported on its edges by the interior surfaces of the angle iron. Cage 15 is dimensioned in accordance with the size of the foam block workpiece. A typical foam block used in constructing the wall of a standard home requires 4 by 8 panels, 8 inches thick. However, thicker blocks would be required for commercial applications. Cable 35 is attached to the bottom of cage 15, more or less centered on the long axis. Cable 35 is shown as single for the sake of clarity in the drawing, however, a matching cable 35 would preferably be attached on the opposite side of cage 15 so that the cage 15 can be smoothly raised. Electric motor 26 is attached to pulley housing 25 which reduces the speed and ensures that case 15 will be raised at approximately 1 foot per minute which the inventor has determined to be about optimum for the contritions described above. Cage 15 is guided within frame 20 between vertical members 17 and 18 by additional angle iron supports (not shown for the sake of clarity) so that cage 15 will maintain the proper orientation relative to the bore forming assembly.

The bore forming assembly consists of a plurality of tubular bore forming members 30, each with its own heating element 32, located at the bottom end of member 30. Each member 30 is aligned substantially centered on the short axis of cage 15, which corresponds to the thickness of the block to be cut. Each member 30 is also aligned along the longest axis of cage 15 which corresponds to the length of the block to be bored. The length of each member 30 corresponds to the width of the block to be bored.

The cross-sectional shape of member 30 is preferably square which, as will be discussed below, offers advantages in building construction over foam blocks with cylindrical bores. However, as shown in FIGS. 2A–2C, other cross-sectional shapes can be utilized as well, such as rectangles, ellipses, polygons, circles, even free form. Also, each member 30 does not have to have the same shape as it neighbor. The invention when used for the packaging industry may have a plurality of members 30, each of different size and shape.

When used to fabricate foam blocks for building construction, the distance between each member 30 must be accurately set so that the concrete column distance will be uniform. In this manner, a wall can be obtained having any desired strength performance characteristics.

In operation, a foam block (not shown) is placed into cage 15 via opening 24. Each heating element 32 is connected in parallel. Cage 15 is slowly moved into bore forming assembly. As cage 15 is moved upward, the heating elements 32 melt a channel within a block so that member 30 easily enters the block. A core is correspondingly collected inside member 30. Once cage 15 reaches the top of frame 20 along vertical support members 17 and 18, the boring process is completed and cage 15 can be rapidly returned to its lowered state. The bored foam block is removed and the cores within each member 30 drop clear. These cores are then collected and re-used so that very little foam is wasted in the process. Most importantly, the invention produces no environmentally unsound free polystyrene beads.

Figure 2:
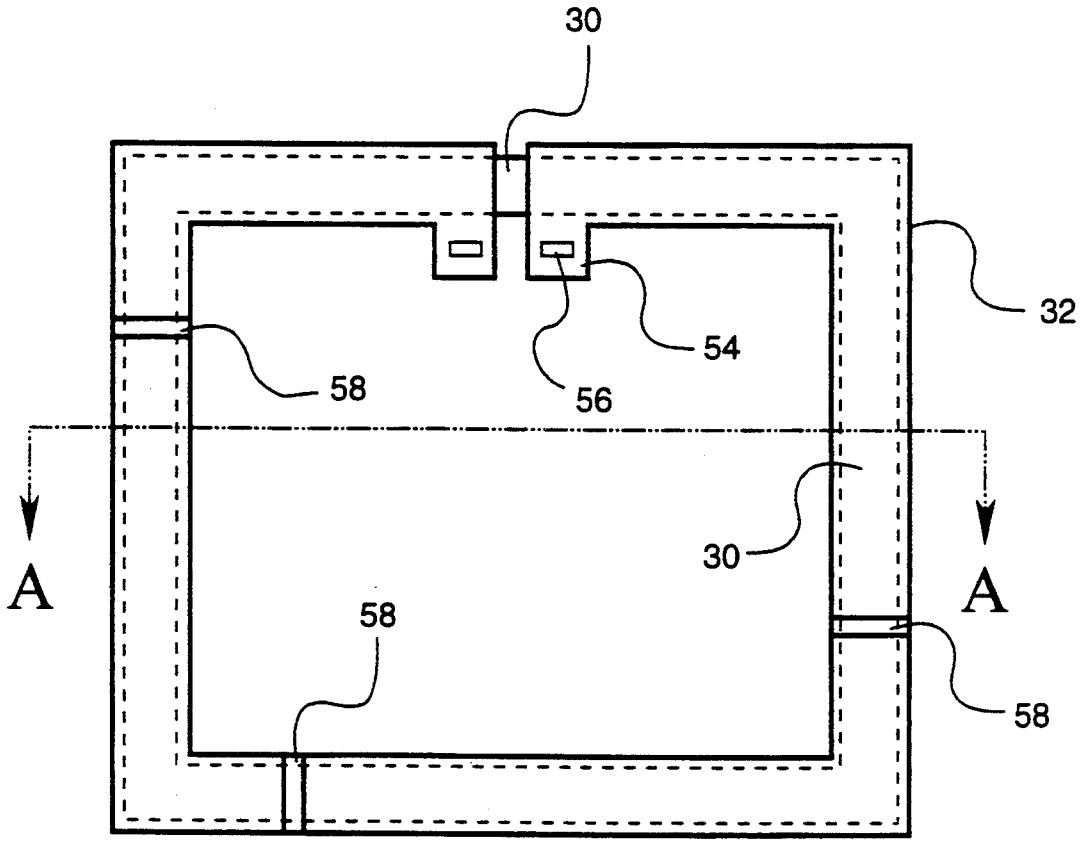
FIG. 2 is a bottom view of one of the tubular bore forming members as viewed from the foam contact end.
Figure 2A:
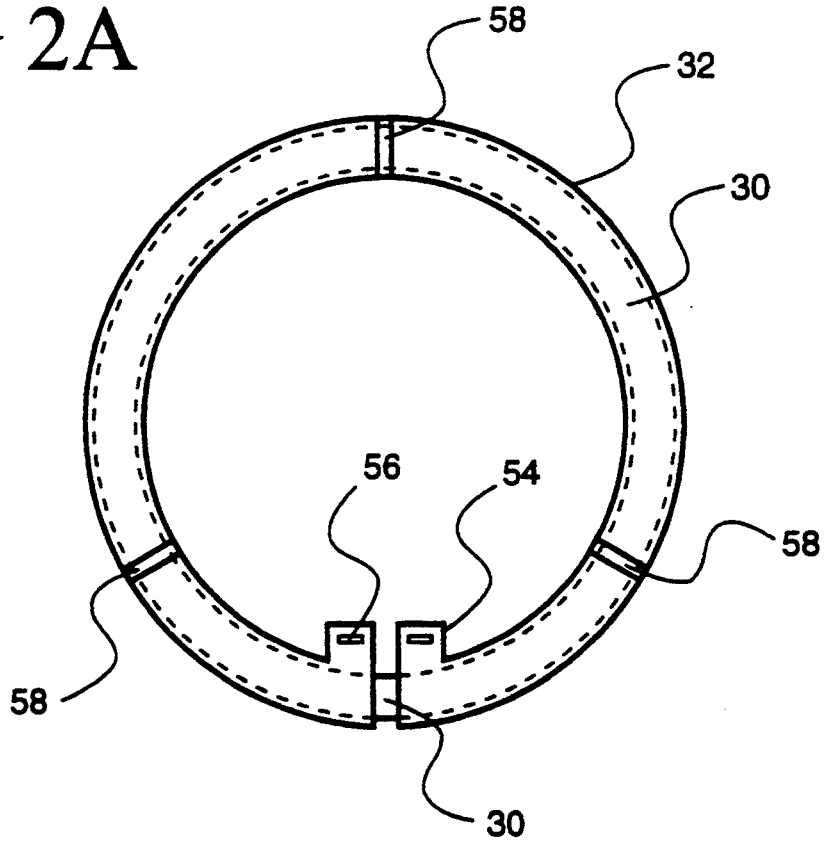
FIG. 2A is a bottom view of one of the tubular bore forming members wherein the cross-sectional shape of the member is a circle.
Figure 2B:
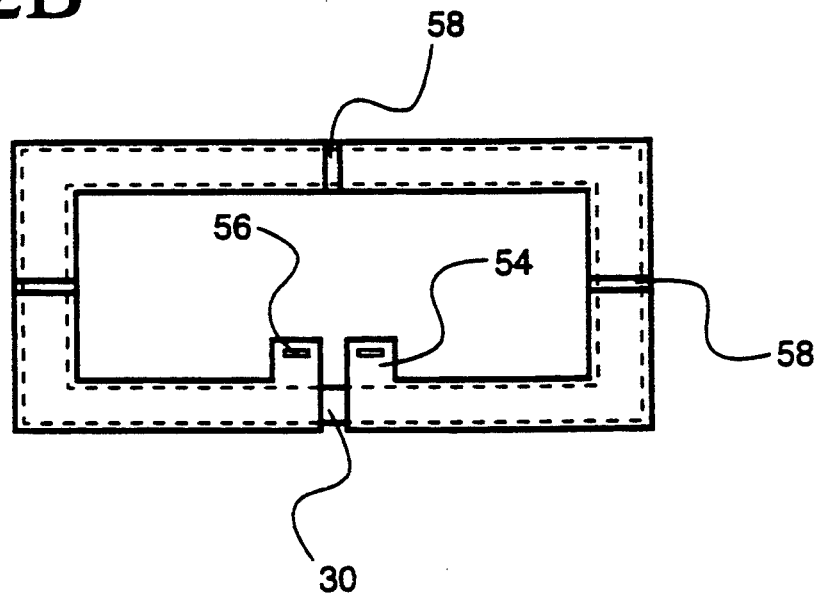
FIG. 2B is a bottom view of one of the tubular bore forming members wherein the cross-sectional shape of the member is a rectangle.
Figure 2C:
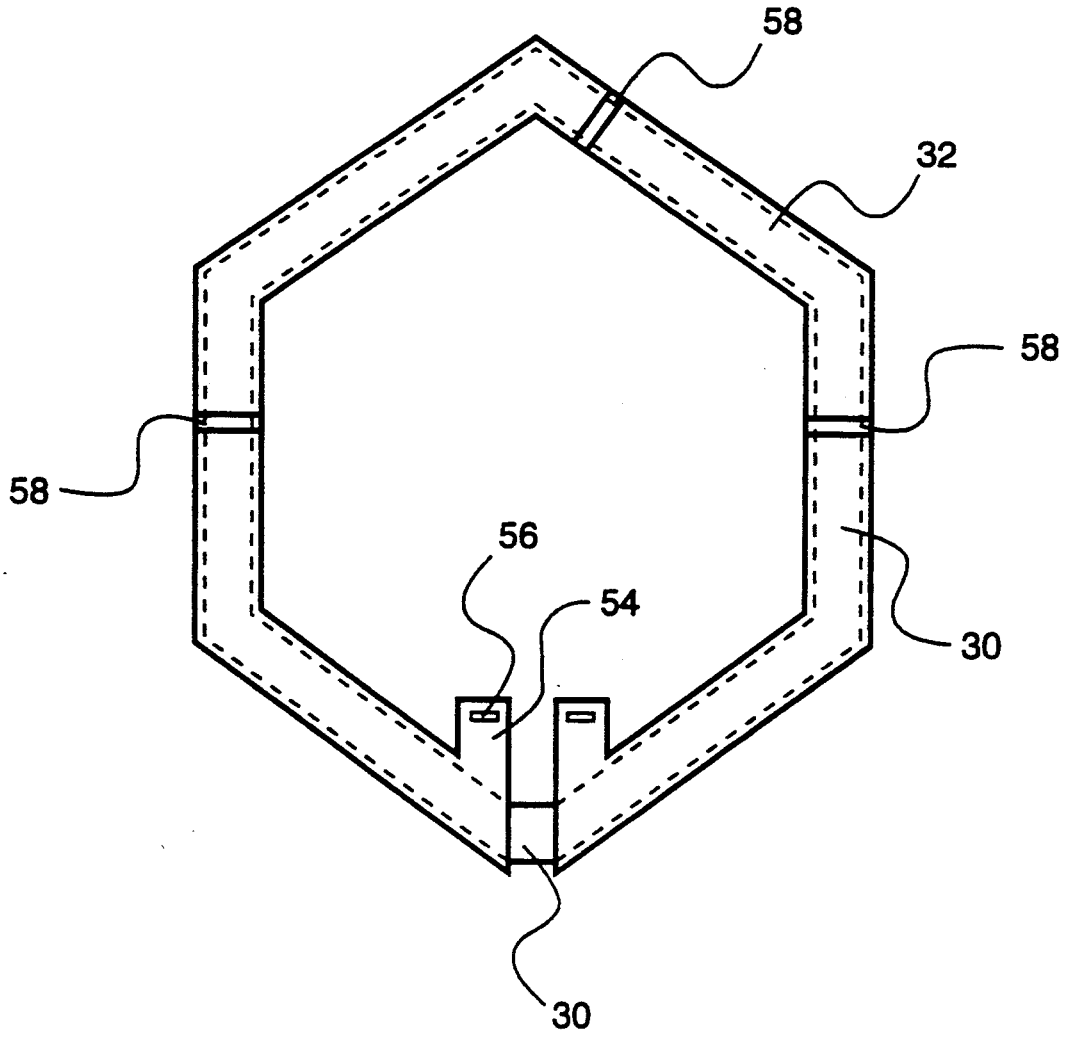
FIG. 2C is a bottom view of one of the tubular bore forming members wherein the cross-sectional shape of the member is polygon.

FIG. 2 is a bottom view of one of the tubular bore forming members as viewed from the foam contact end. Bore forming member 30 is again shown as a square but is not limited to that configuration. Along the bottom of member 30 is resistive heating element 32. Heating element 32 is preferably CALROD as manufactured by the General Electric Corporation, however, other types are also suitable. The shape of element 32 corresponds to the shape and dimensions of tubular member 30. If the wall thickness of member 30 is 3/16 inches, then heating element 32 would be preferably ¼ inches so that heating element 32 is always at greater than or equal to the wall dimensions of member 30. In this way, a channel is cut in the foam block that enables member 30 to easily enter.

Figure 3:
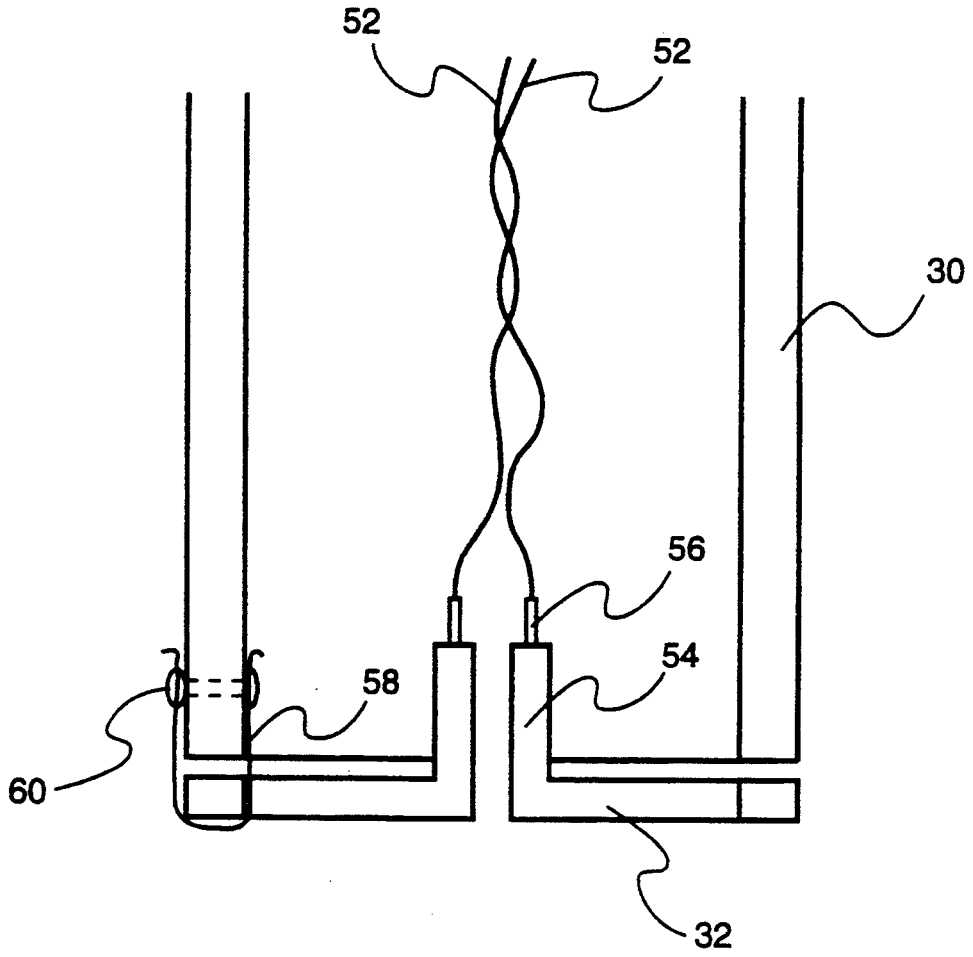
FIG. 3 is a cross-sectional view of a tubular bore forming member along line AA as shown in FIG. 2.

FIG. 3 is a cross-sectional view of a tubular bore forming member along line AA as showing in FIG. 2. Extensions 54 of heating element 32 extend about an inch or two adjacent to the interior wall of member 30. At the end of extensions 54 are connectors 56 which connect wires 52 which feeds electricity to the heating element. Extensions 54 provide additional heating to form a semi-circular channel on the inside of member 30 thereby providing a chase for wires 52. The inventor has found, given the rate of motion specified above, that the ideal wattage of heating elements 32 is approximately 350 watts. However, heating elements of a greater wattage can be used, providing a voltage reduction device is placed in the circuit, such as a VARI-AC.

Element 32 is preferably attached to member 30 using copper straps 58 which are placed around element 32 and pop-riveted, using copper rivets, to member 30. The number of rivets used is not critical but should be sufficient to make certain heating element 32 maintains its position during the bore cutting process.

Figure 4:
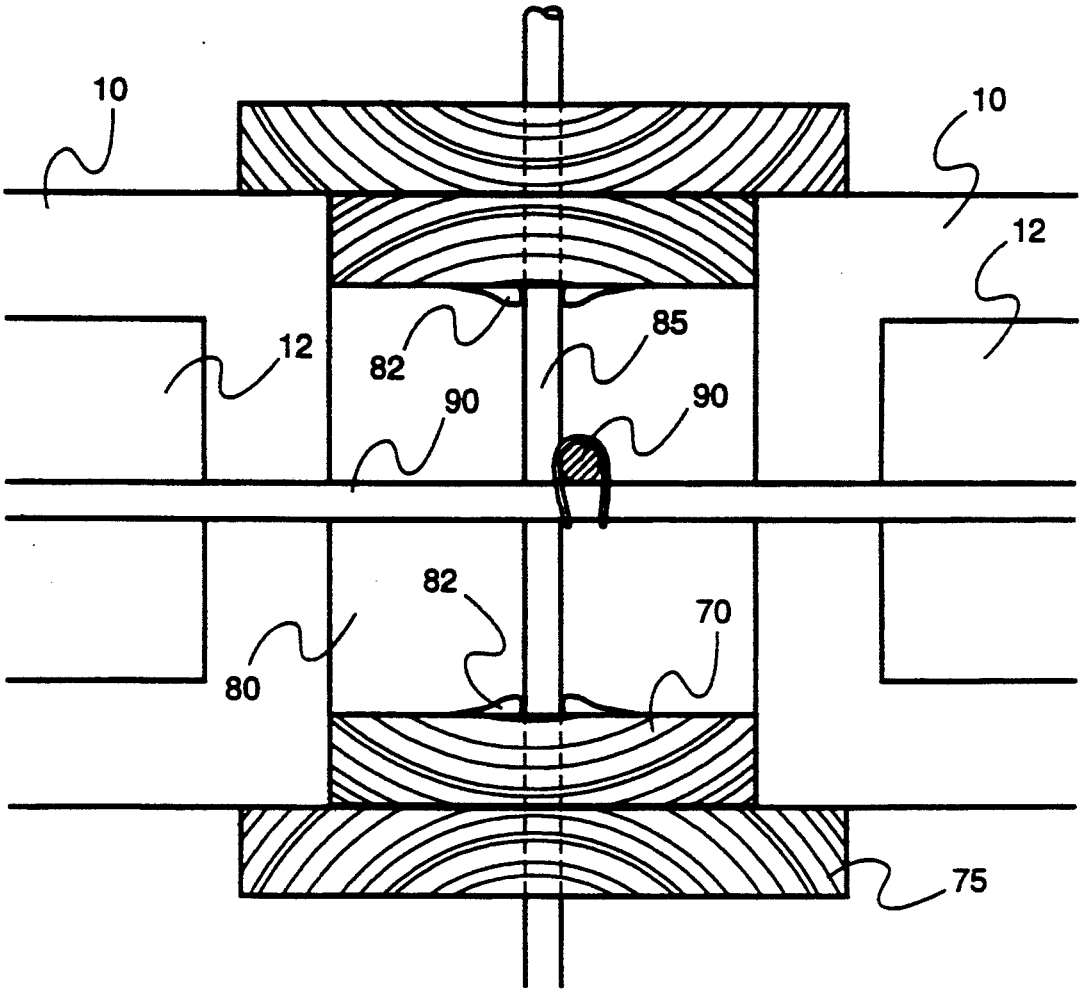
FIG. 4 is a top view of two foam blocks fabricated in accordance with the invention being fastened together to form a wall of a building.

FIG. 4 is a top view of two foam blocks fabricated in accordance with the invention being fastened together to form a wall of a building. Foam blocks 10 have square-shaped bores 12 formed in them using the invention. For a typical home, block 10 should be 4' by 8', 8" thick with six 5" by 5" bores, approximately 16" on center. When filed with concrete and no. 4 rebar, a wall of these specifications will be stronger than a wall fabricated from 2 by 6's, 12" on center. The use of square construction columns permit greater spacing of the columns due to the increased strength. Also, it is far easier to attach a fastener on a flat concrete surface that on a sharply radiused surface that is provided by cylindrical foam borings used with prior methods.

Blocks 10 are fastened together using preferably 2 by 6 framing member 75 which overlaps the surface of both blocks. Positioned between blocks 10 are preferably 2 by 4 framing members 70. The two blocks and the associated framing members are then held together by form ties 85 until the concrete is poured and sets. Any standard form tie is suitable such as Richco Single Waler Forming System. However, the distance between washers 82 must be adjusted to particular thickness of the foam block used. No. 4 rebar 90 is placed within the voids and bores 12 to provide additional strength to the structure. After the concrete has hardened, the snap ties and the framing members 75 and 70 can be removed. However, if left in place, these can then be a structural pan of the dwelling serving as hailers for T-111 or other similar siding on the outside and drywall or panelling on the inside.

Figure 5:
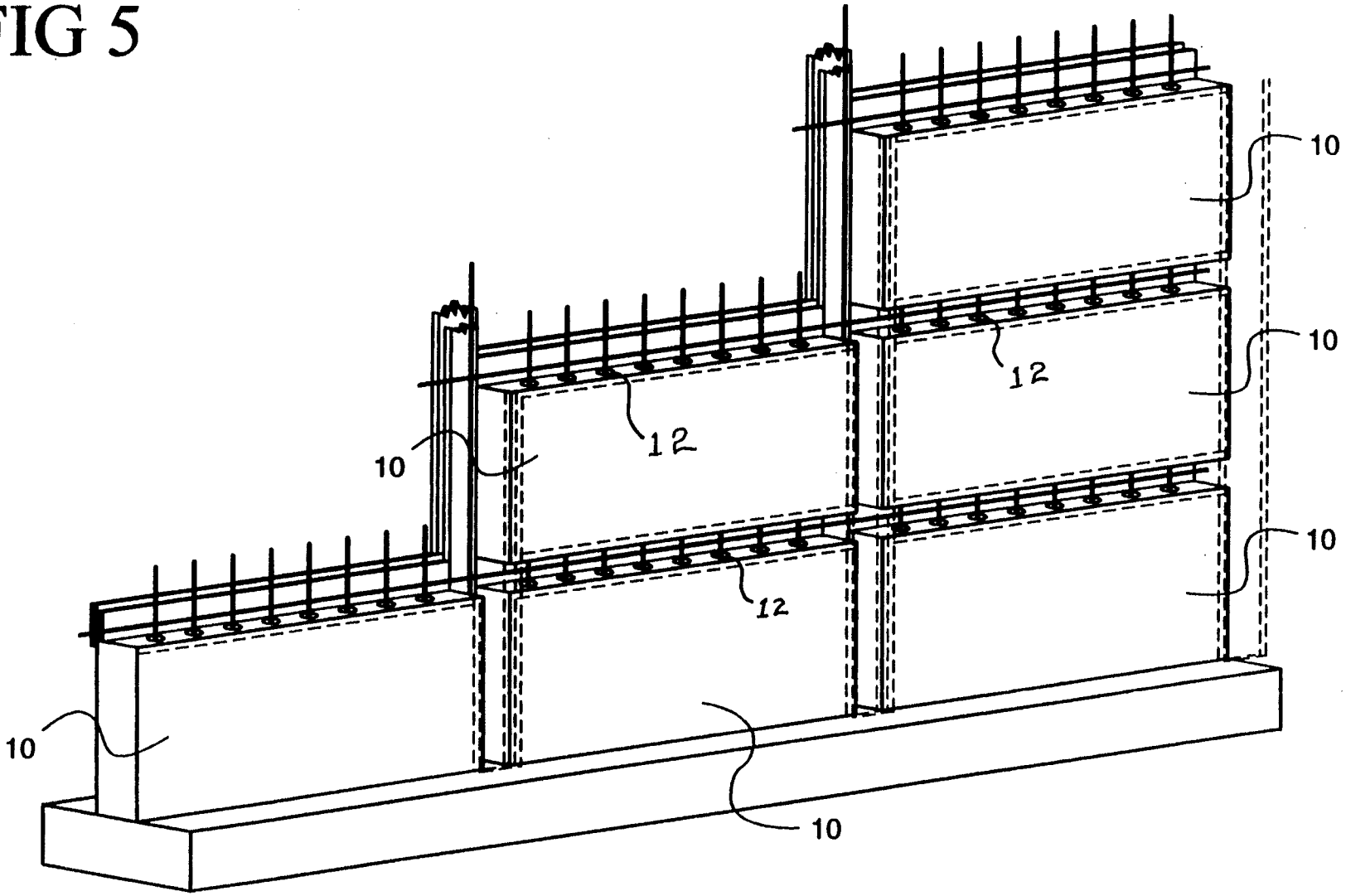
FIG. 5 is an exterior side view of a partial wall with the foam blocks connected together ready for concrete pouring.

FIG. 5 is an exterior side view of a partial wall with the foam blocks connected together ready for concrete pouring. In this embodiment, foam blocks 10 are shown with cylindrical bores 12. However, the blocks are connected the same as shown in FIG. 4. In FIG. 5, the blocks are shown as being bored along the 4' axis which is the preferable method of doing it. However, it is also possible to make an 8' bore using the invention if that type of block was desired.

Figure 6:
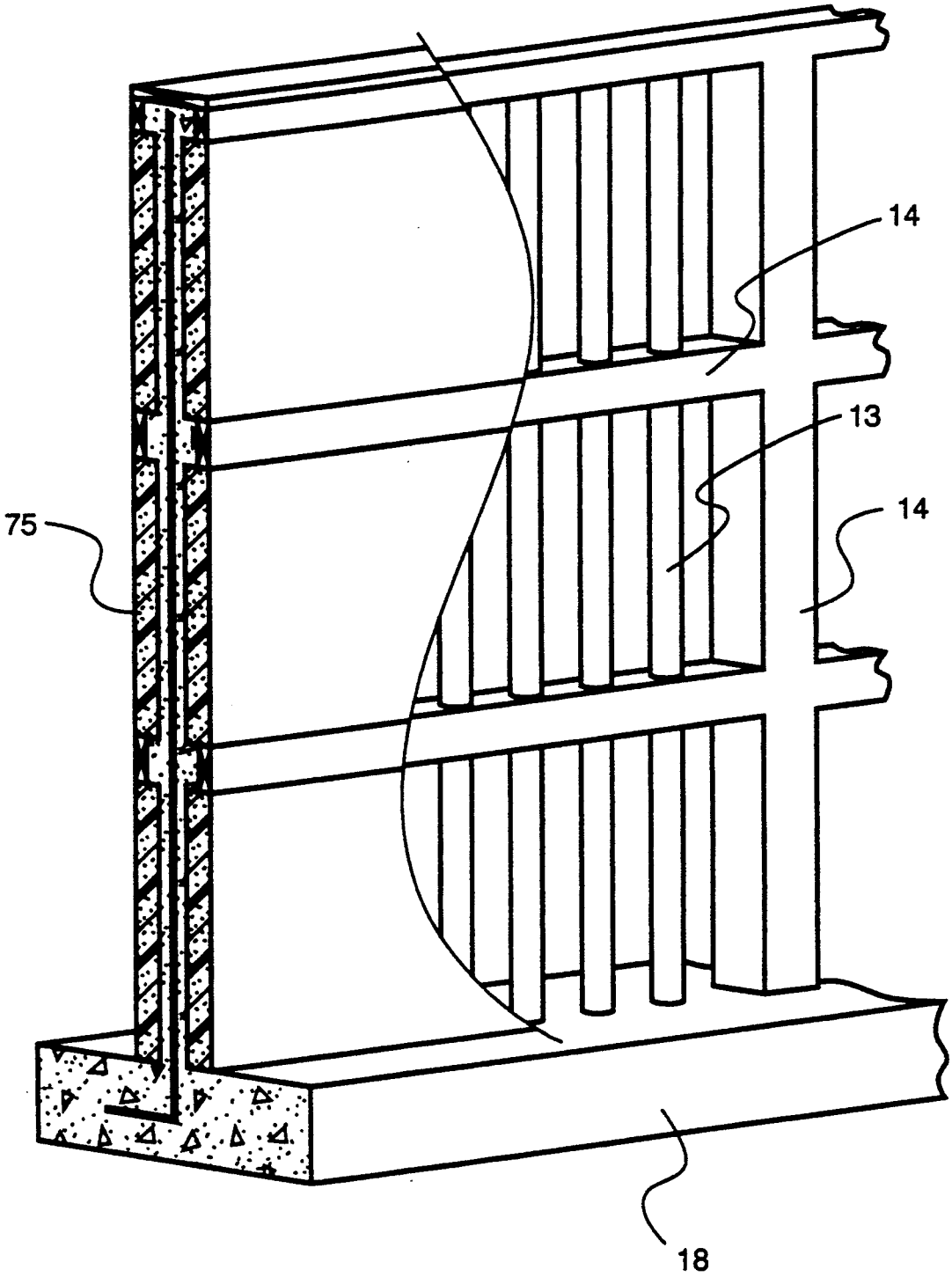
FIG. 6 shows a cut away view of a completed wall fabricated using an alternative embodiment of the apparatus.

FIG. 6 shows a cut away view of a completed wall fabricated using an alternative embodiment of the apparatus. In this view, the columns 13 are again shown cylindrical. The voids between the framing members 70 and 75, serve as forms for columns 14. By using this system, the entire wall including footing 18 can be fabricated in a single pouring, thus providing a much stronger structure, far more quickly and less expensively than with present methods.

While there have been described what are at present considered to be the preferred embodiments of this invention, it will be obvious to those skilled in the art that various changes and modifications may be made therein without departing from the invention and it is, therefore, aimed to cover all such changes and modifications as fall within the true spirit and scope of the invention.

What is claimed is:

1. A bore making apparatus for a foam block comprising:

a frame;

a plurality of tubular, hollow bore forming members, each bore forming member having an open top end and an open bottom end and having a predetermined wall thickness, each said bore forming member having a defined cross-sectional shape, which is substantially uniform from the top end to the bottom end, said bore forming members being aligned in an array and attached to said frame, with each member spaced a pre-determined distance from an adjacent one of said members;

each bore forming member further comprising a resistive heating element having a predetermined heat output, attached to the bottom end, wherein said resistive heating element corresponds in cross-sectional shape and wall thickness to said bore forming member for forming a channel within said foam block corresponding to the cross-sectional shape and wall thickness of said tubular bore forming member;

foam supporting means for rigidly holding said foam block, slidably mounted within said frame;

means for sliding said foam supporting means into said array of bore forming members at a predetermined rate corresponding to said predetermined heat output, such that a plurality of bores of uniform thickness and cross-section are substantially simultaneously formed within said foam block with cores of said bores being enclosed within said tubular bore forming members.

2. The apparatus of claim 1 wherein said frame further comprises a metal frame of angle iron.

3. The apparatus of claim 2 wherein said foam supporting means further comprises a metal frame of angle iron.

4. The apparatus of claim 3 wherein said means for sliding further comprises a cable mechanism attached to said foam supporting means and an electric motor.

5. The apparatus of claim 4 wherein the cross-sectional shape of each said bore member and its attached resistive heating element is substantially a square.

6. The apparatus of claim 4 wherein the cross-sectional shape of each said bore member and its attached resistive heating element is substantially a circle.

7. The apparatus of claim 4 wherein the cross-sectional shape of each said bore member and its attached resistive heating element is substantially a rectangle.

8. The apparatus of claim 4 wherein the cross-sectional shape of each said bore member and its attached resistive heating element is a polygon.

9. The apparatus of claim 4 wherein the cross-sectional shape of each said bore member and its attached resistive heating element in the array is substantially identical.

10. The apparatus of claim 4 wherein said array of said bore members and their attached resistive heating elements have at least two bore members and their respective attached resistive heating elements which differ from each other in cross-sectional shape.

11. The apparatus of claim 4 wherein said resistive heating elements are attached to their respective bore members using copper straps and rivets.

* * * * *